US008925128B2

(12) United States Patent
Fiore, Jr. et al.

(10) Patent No.: US 8,925,128 B2
(45) Date of Patent: Jan. 6, 2015

(54) CHILD HOLDING ACCESSORY SUITABLE FOR USE WITH A PLAY YARD

(75) Inventors: Joseph F. Fiore, Jr., Lebanon, PA (US); Curtis M. Hartenstine, Birdsboro, PA (US); Andrew J. Horst, West Lawn, PA (US); Zeng-Wen Guo, Central Hong Kong (HK); Nangui Bu, Central Hong Kong (HK)

(73) Assignee: Wonderland Nurserygoods Company Limited, Hong Kong (HK)

( * ) Notice: Subject to any disclaimer, the term of this patent is extended or adjusted under 35 U.S.C. 154(b) by 211 days.

(21) Appl. No.: 13/207,489

(22) Filed: Aug. 11, 2011

(65) Prior Publication Data

US 2012/0037870 A1 Feb. 16, 2012

Related U.S. Application Data

(60) Provisional application No. 61/401,310, filed on Aug. 11, 2010, provisional application No. 61/463,390, filed on Feb. 16, 2011.

(30) Foreign Application Priority Data

Jul. 29, 2011 (CN) ..... 2011 1 0215584

(51) Int. Cl.
*A47D 7/00* (2006.01)
*A47D 9/00* (2006.01)
*A47D 13/06* (2006.01)

(52) U.S. Cl.
CPC ..... *A47D 9/005* (2013.01); *A47D 13/063* (2013.01)
USPC ..... 5/99.1; 5/98.1; 5/655

(58) Field of Classification Search
USPC ..... 5/655, 99.1, 100, 98.1, 947, 652, 697, 5/705, 101, 93.2
See application file for complete search history.

(56) References Cited

U.S. PATENT DOCUMENTS 4,882,799 A 11/1989 Shapiro
5,369,826 A 12/1994 Ikeda (Continued)

FOREIGN PATENT DOCUMENTS

CN 2209909 Y 10/1995
CN 1383775 A 12/2002

(Continued)

OTHER PUBLICATIONS

Translation of abstract of CN102631103A Mar. 20, 2014.*

(Continued)

*Primary Examiner* — Peter M Cuomo
*Assistant Examiner* — Brittany Wilson
(74) *Attorney, Agent, or Firm* — David I. Roche; Baker & McKenzie LLP

(57) ABSTRACT

A child holding accessory can be desirably installed on the play yard for use, and has two regions on opposite sides adapted to receive a child in different configurations of use. Examples of construction for these holding regions can include, without limitation, a changing table and a child sleeping bed. The child holding accessory can include a support board, and a cushion element mounted with the support board. The support board is configured to deform differently depending on whether the child is placed on the first or second region, so that the bearing surfaces associated with the holding regions can have different firmness to provide adequate resting of the child.

20 Claims, 11 Drawing Sheets

(56) References Cited

U.S. PATENT DOCUMENTS

| | | | | |
|---|---|---|---|---|
| 6,173,462 | B1 | 1/2001 | Huang et al. | |
| 6,539,563 | B1 | 4/2003 | Hsia | |
| 2006/0130237 | A1 | 6/2006 | Clapper et al. | |
| 2006/0225204 | A1 | 10/2006 | Bretschger et al. | |
| 2006/0225205 | A1 | 10/2006 | Troutman | |
| 2006/0253979 | A1 | 11/2006 | Chen | |
| 2008/0034506 | A1 | 2/2008 | Chen et al. | |
| 2011/0225729 | A1 * | 9/2011 | Liu et al. | 5/93.1 |
| 2012/0204347 | A1 * | 8/2012 | Li | 5/93.1 |

FOREIGN PATENT DOCUMENTS

| | | | | |
|---|---|---|---|---|
| CN | 20161386 | Y | | 5/2008 |
| CN | 01361627 | A | | 2/2009 |
| CN | 101361627 | A | | 2/2009 |
| CN | 201370338 | Y | | 12/2009 |
| CN | 201664118 | U | * | 12/2010 |
| CN | 102631103 | A | * | 8/2012 |
| DE | 202008017117 | U1 | | 5/2009 |
| WO | 8402260 | A1 | | 6/1984 |

OTHER PUBLICATIONS

Translation of CN201664118U Mar. 20, 2014.*

* cited by examiner

CHILD HOLDING ACCESSORY SUITABLE FOR USE WITH A PLAY YARD

CROSS-REFERENCE TO RELATED APPLICATION(S)

This application claims priority to U.S. Provisional Patent Application No. 61/401,310 filed on Aug. 11, 2010; and to U.S. Provisional Patent Application No. 61/463,390 filed on Feb. 16, 2011; and to China Patent Application No. 201110215584.0 filed on Jul. 29, 2011.

BACKGROUND

1. Field of the Invention

The present invention relates to child holding accessories suitable for use with play yards.

2. Description of the Related Art

Play yards are used to contain and provide a safe environment for a child to sleep or play. Currently, most play yards are constructed to include a frame around which a fabric element is wrapped and stretched to form the boundaries of the play yard. Due to the wide spread use of play yards, efforts have been made to increase their versatility to caregivers. For example, some child holding accessories may be added to play yards, such as changing tables (also commonly called "changers", bassinets, and child sleeping beds (also commonly called "nappers"). While these different types of accessories may provide more versatility, it may be expensive to purchase a different accessory for each use. Moreover, it may also be cumbersome to store multiple child holding accessories, or change the accessory for each different use.

Therefore, there is a need for an improved child holding accessory that may be more convenient in use, provide comfortable resting support and address at least the foregoing issues.

SUMMARY

The present application describes a child holding accessory that can be used in combination with a play yard. The child holding accessory can be desirably installed on the play yard, and integrate multiple regions adapted to receive the child in different configurations of use. Examples of construction for these holding regions can include, without limitation, a changing table and a child sleeping bed.

In one embodiment, the child holding accessory comprises a resting support, and at least one fixture adapted to attach the resting support with a play yard. The resting support has opposite first and second regions respectively adapted to receive the child, wherein the first region has a first bearing surface and the second region has a second bearing surface, the first and second bearing surfaces having different firmness such that the first and second bearing surfaces has different bending curvatures.

In another embodiment, a child holding accessory can include a support board having a first side and a second side, and a cushion element mounted with the support board, the support board being configured to deform differently depending on whether an external load pressure is exerted on the first side or the second side of the support board structure.

At least one advantage of the structures described herein is the ability to provide a child holding accessory that can integrate two opposite regions adapted to receive the child in different configurations of use. The bearing surfaces associated with the two regions can deform differently when the child is placed thereon. Accordingly, the bearing surfaces of the two regions can be designed to provide differential firmness and bending curvature that suits the different functional uses of the two regions.

DETAILED DESCRIPTION OF THE EMBODIMENTS

The present application describes a child holding accessory that can be used in combination with a play yard. The child holding accessory can integrate multiple regions adapted to receive the child in different configurations of use. Examples of construction for these holding regions can include, without limitation, a changing table and a child sleeping bed. Each of the holding regions can be designed to deform differently when the child is placed thereon so as to provide adequate resting support.

Figure 1:
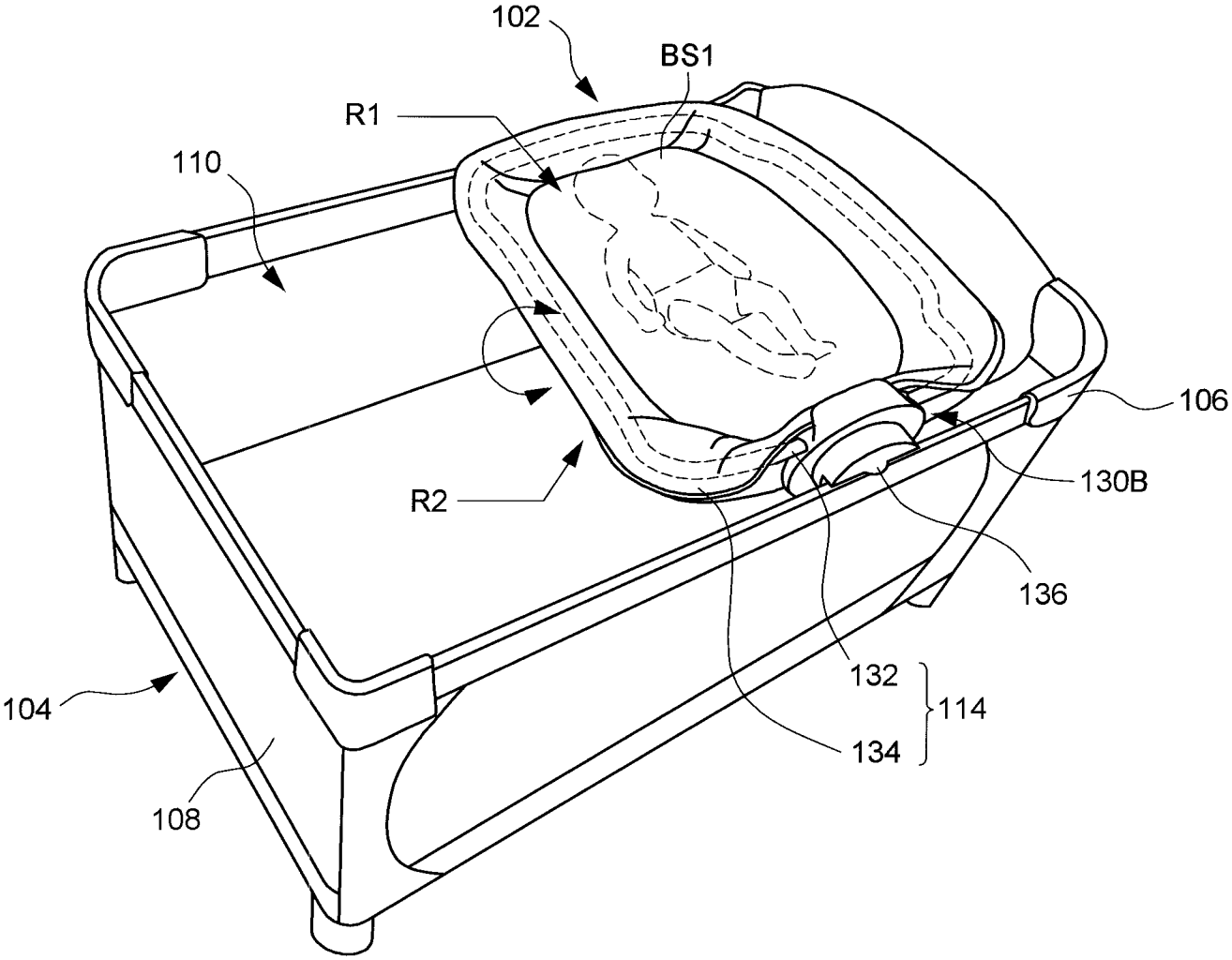
FIG. 1 is a schematic view illustrating a play yard provided with a child holding accessory in a first configuration of use.
Figure 2:
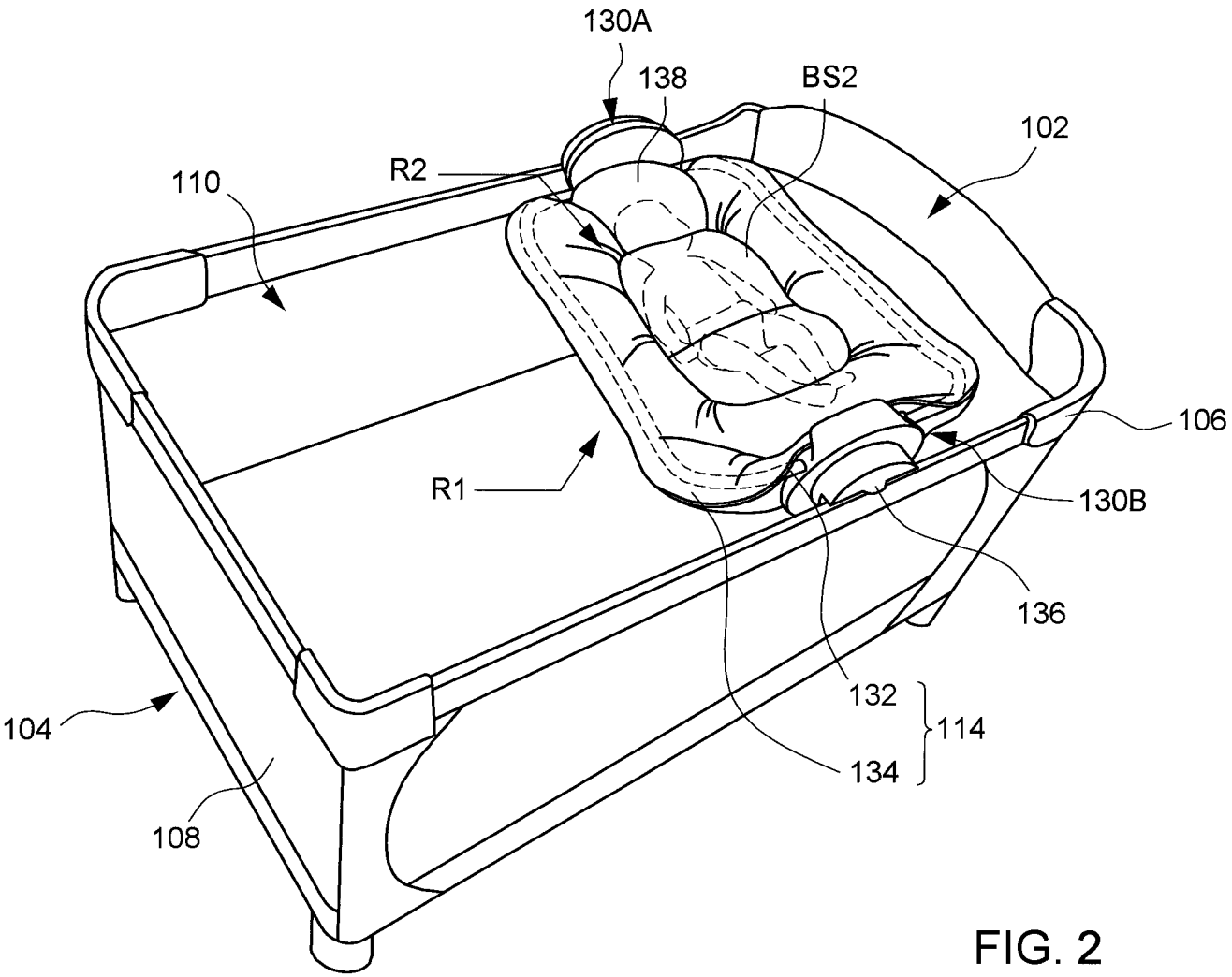
FIG. 2 is a schematic view illustrating the play yard of FIG. 1 with the child holding accessory in a second configuration of use.
Figure 3:
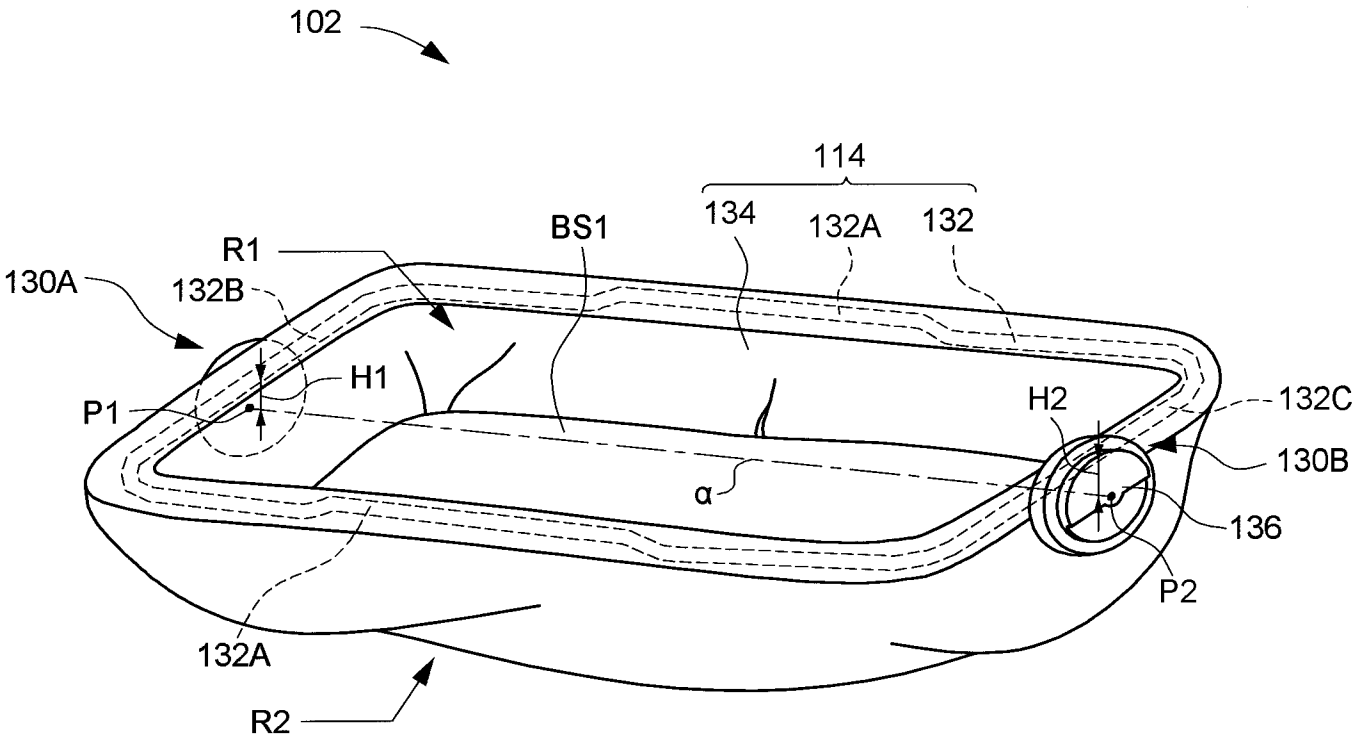
FIG. 3 is a schematic view illustrating a first side of the child holding accessory.
Figure 4:
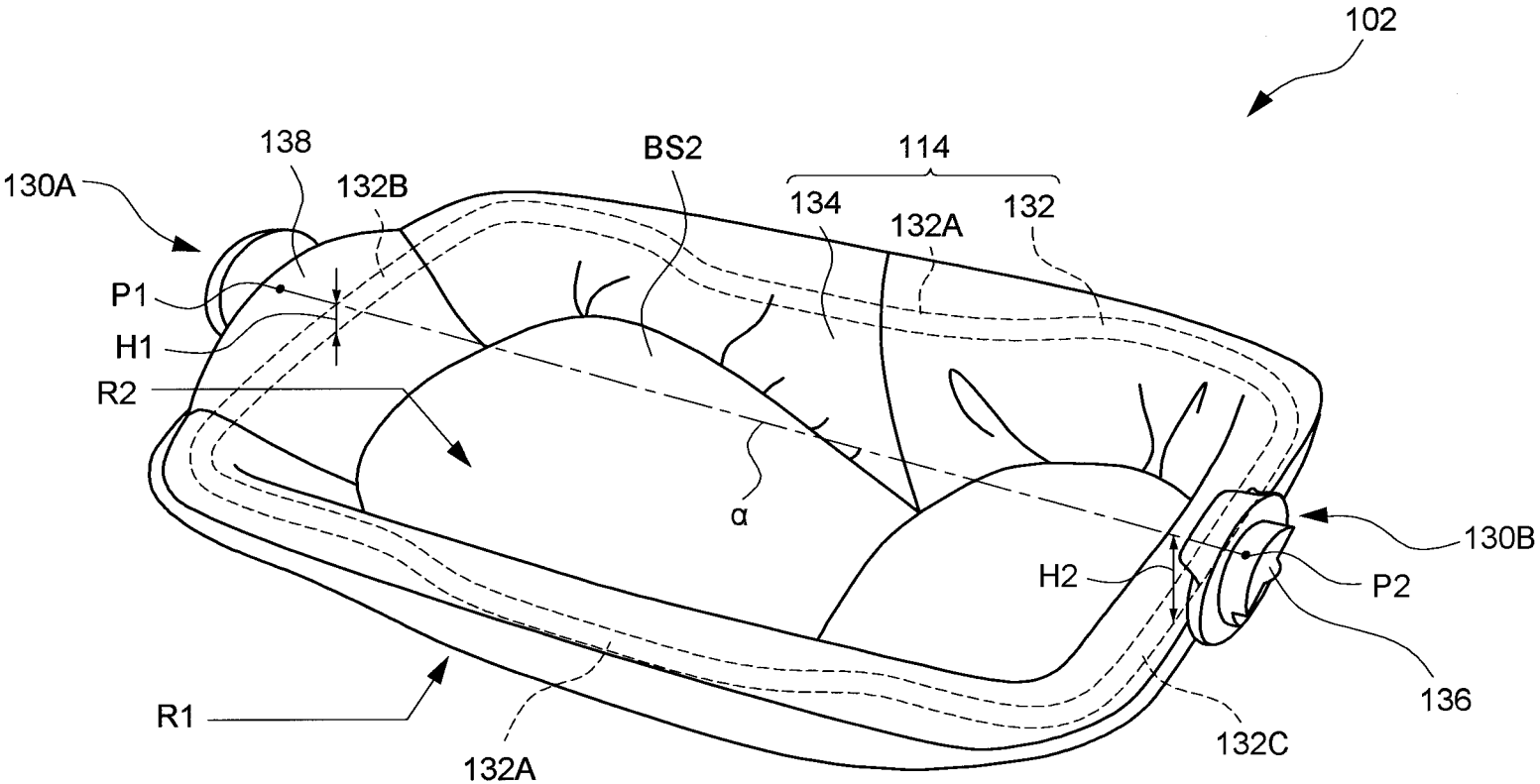
FIG. 4 is a schematic view illustrating a second side of the child holding accessory opposite to the first side.

FIGS. 1 and 2 are schematic views illustrating an embodiment of a child holding accessory 102 suitable for use with a play yard 104, and FIGS. 3 and 4 are schematic views respectively illustrating two opposite sides of the child holding accessory 102. Referring to FIGS. 1 and 2, the play yard 104 can include a rigid support frame 106 over which is held an enclosure 108 that defines an inner space 110 opened upward. In one embodiment, the enclosure 108 can be made of a flexible cloth material that is stretched around the support frame 106 to define multiple sidewalls surrounding the inner space 110. The child holding accessory 102 can be detachably mounted at an upper side of the enclosure 108 above the inner space 110. The child holding accessory 102 is thereby adapted to receive a child at an elevated position on the play yard 104 for facilitating the care of the child.

The child holding accessory 102 can be constructed as an adjustable module that includes a resting support 114 having multiple regions adapted to receive the child. Examples of these regions can include, without limitation, a first region R1 constructed as a changing table, and a second region R2 constructed as a child sleeping bed on a side opposite to the side of the first region R1. The child holding accessory 102 can be adjustable to turn the second region R2 downward and the first region R1 upward to be used as a changing table (as shown in FIG. 1), or to reversely turn the first region R1 downward and the second region R2 upward to be used as a child sleeping bed (as shown in FIG. 2). This adjustment of the child holding accessory 102 can be permitted by using one or more adjustable fixtures 130A, 130B to attach the resting support 114 with the play yard 104.

In one embodiment, the resting support 114 can include a surrounding frame 132 formed from multiple tubular segments connected together, and a bearing platform 134 affixed with the surrounding frame 132. The adjustable fixtures 130A and 130B may be mounted with two opposite sides of the surrounding frame 132, and are adapted to fasten the resting support 114 with two opposite handrails of the play yard 104. In one embodiment, at least one of the two adjustable fixtures, for example adjustable fixture 130A, can include a rotary mechanism that is operable to permit relative rotation of the resting support 114. While the adjustable fixture 130A is attached with the support frame 106, the resting support 114 thus can be rotated relative to the play yard 104 to turn either of the first region R1 and the second region R2 upward. The other fixture 130B can have an adjustable catch 136 that can bear on the associated handrail of the play yard 104.

FIG. 3 shows the first region R1 of the child holding accessory 102, and FIG. 4 shows the second region R2 of the child holding accessory 102. As shown in FIGS. 3 and 4, the first region R1 used as a changing table can have a relatively flat bearing surface BS1. The first bearing surface BS1 thus can provide a stable support to allow a parent to conveniently change the child's diaper. The second region R2 used as sleeping bed can have a second bearing surface BS2 that has a raised head portion 138 that is higher than other regions of the second bearing surface BS1. According to one embodiment, the head portion 138 can be formed by a piece of fabric that has one edge sewed at a higher position, or that is securely held with the fixture 130A via a strap. The child can be placed on the second bearing surface BS2 with the head resting at a higher level on the head portion 138 so as to provide a more comfortable sleeping position.

The left and right sides of the surrounding frame 132 can also include side frame segments 132A that have a curved shape. When the first region R1 is turned upward, the side frame segments 132A can respectively have curved shapes that project/arch upward to gather and tighten a fabric material between the surrounding frame 132 and the first bearing surface BS1. Moreover, the side frame segments 132A can increase the height of the left and right side edges of the changing table, which can prevent the child from accidentally falling down and provide safer use. When the second region R2 is turned upward, the curved shapes of the side frame segments 132A are projecting/arching downward to facilitate downward bending of the second bearing surface BS2 and provide comfortable sleeping support.

Figure 4A:
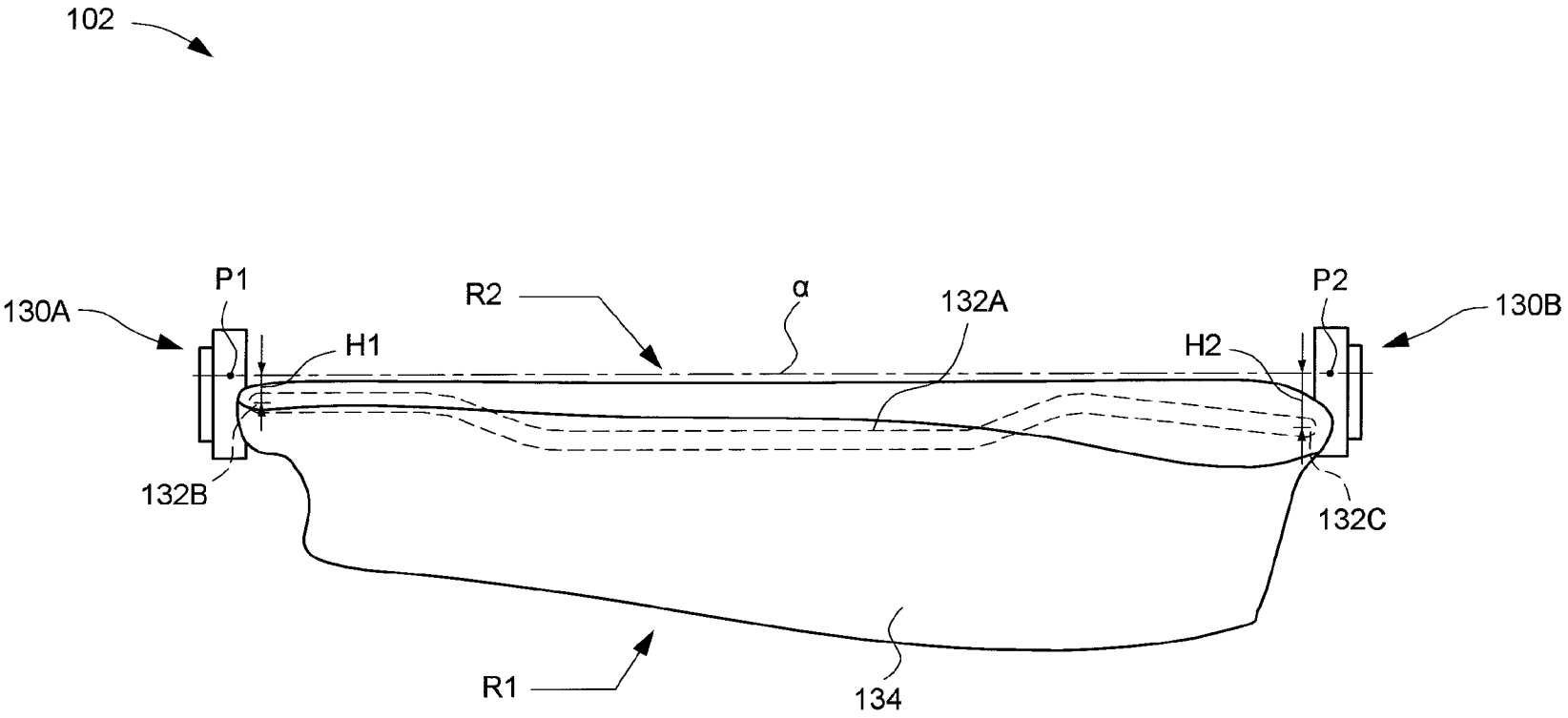
FIG. 4A is a schematic side view of the child holding accessory with the second region turned upward.

In conjunction with FIGS. 3 and 4, FIG. 4A is a schematic side view illustrating the child holding accessory 102 with the second region R2 turned upward. The surrounding frame 132 can also include a head-side frame segment 132B and a foot-side frame segment 132C that are transversally connected between the side frame segments and respectively mounted with the fixtures 130A and 130B. The fixtures 130A and 130B can respectively define pivot points P1 and P2 through which a rotation axis a can pass. The head-side frame segment 132B and the foot-side frame segment 132C can be arranged at different distances H1 and H2 from the rotation axis α, such that the head-side frame segment 132B can be higher than the foot-side frame segment 132C. According to one embodiment, the surrounding frame 132 can be entirely located at a same side of the rotation axis α, and the distance H1 between the head-side frame segment 132B and the rotation axis a can be smaller than the distance H2 between the foot-side frame segment 132C and the rotation axis α. When the first bearing surface BS1 is turned upward, the surrounding frame 132 can be located above the rotation axis α and the foot-side frame segment 132C can be at a position higher than the head-side frame segment 132B to facilitate diaper changing. In contrast, when the second bearing surface BS2 is turned upward to be used as a sleeping bed, the surrounding frame 132 can be located below the rotation axis α and the foot-side frame segment 132C can be at a position lower than the head-side frame segment 132B to provide comfortable sleeping support.

Figure 5:
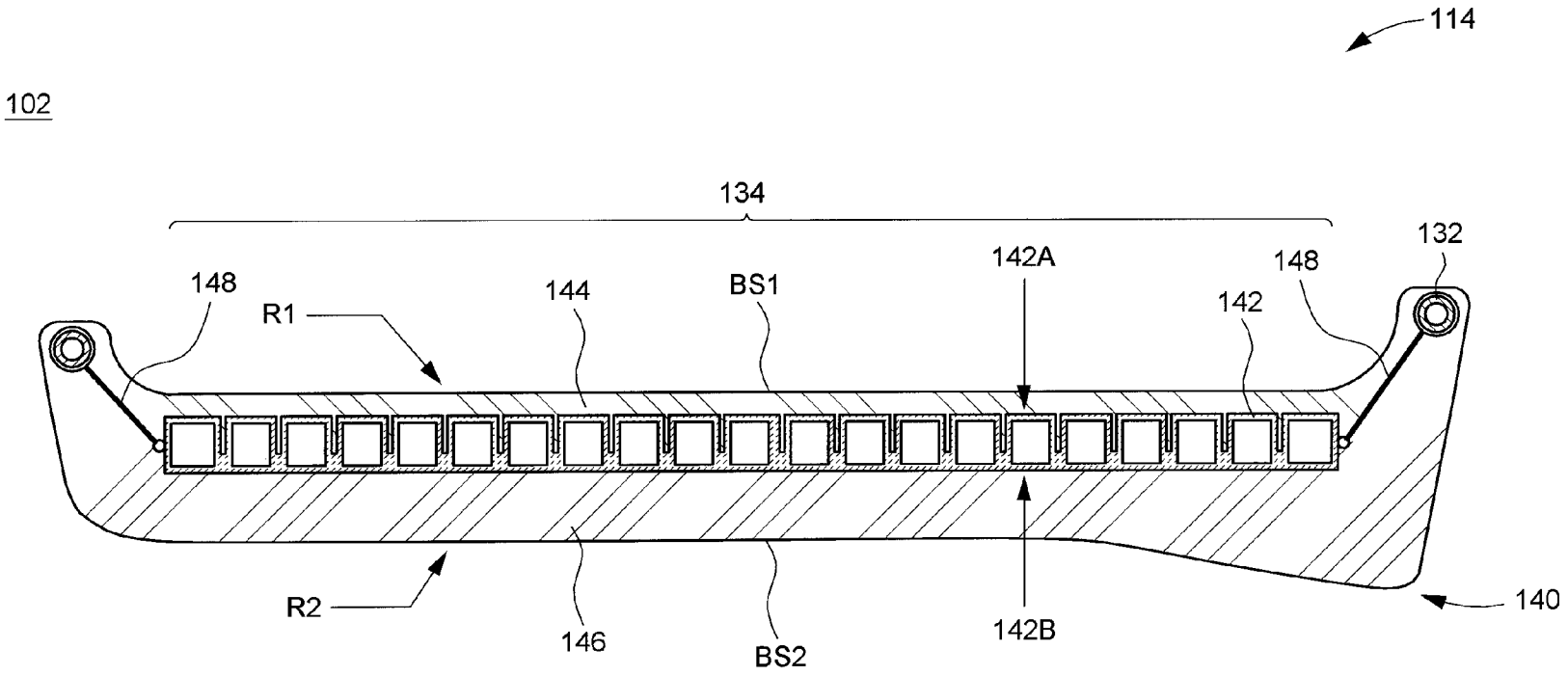
FIG. 5 is a schematic cross-sectional view illustrating the construction of a resting support in the child holding accessory.

FIG. 5 is a schematic cross-sectional view illustrating the resting support 114. The bearing platform 134 can include a flexible cushion element 140 and a support board 142. The cushion element 140 can be assembled to enclose the support board 142, and include a first layer 144 on the side of the first region R1, and a second layer 146 on the side of the second region R2. The first and second layers 144 and 146 can be joined together by sewing, bonding or other suitable techniques. In one embodiment, the first layer 144 used for the changing table can include a fabric that is water-proof and easy to wipe-off, like polyvinyl chloride (PVC)-based or ethylene vinyl acetate (EVA)-based polymer materials. The second layer 146 used for the sleeping bed can include soft and comfortable fabric, like cotton cloth or flannelette. It will be understood that the first and second layers 144 and 146 are not limited to the aforementioned examples, and other flexible/soft materials may be included, such as webbing materials, foamed polymer pad and the like.

The support board 142 can be placed between the first and second layers 144 and 146, and have a first side 142A and an opposite second side 142B. Two opposite ends of the support board 142 can be connected with the surrounding frame 132 via connecting elements 148, such as straps, cords, and the like. The support board 142 can provide a support sufficiently rigid for sustaining the weight of the child received in either of the first and second region R1 and R2. In the meantime, the support board 142 can also be designed to deform differently depending on whether the child is supported on the bearing surface BS1 or BS2. For example, the support board 142 can bend freely when the child is placed on the bearing surface BS2 to conform to the child's body and provide comfortable sleeping. On the other hand, when the child is placed on the bearing surface BS1, bending of the support board 142 is reduced or prevented to provide a flat and stable surface for better accessibility while changing the child's diaper. Exemplary embodiments of the support board 142 are described hereafter with reference to FIGS. 6 through 10.

Figure 6:
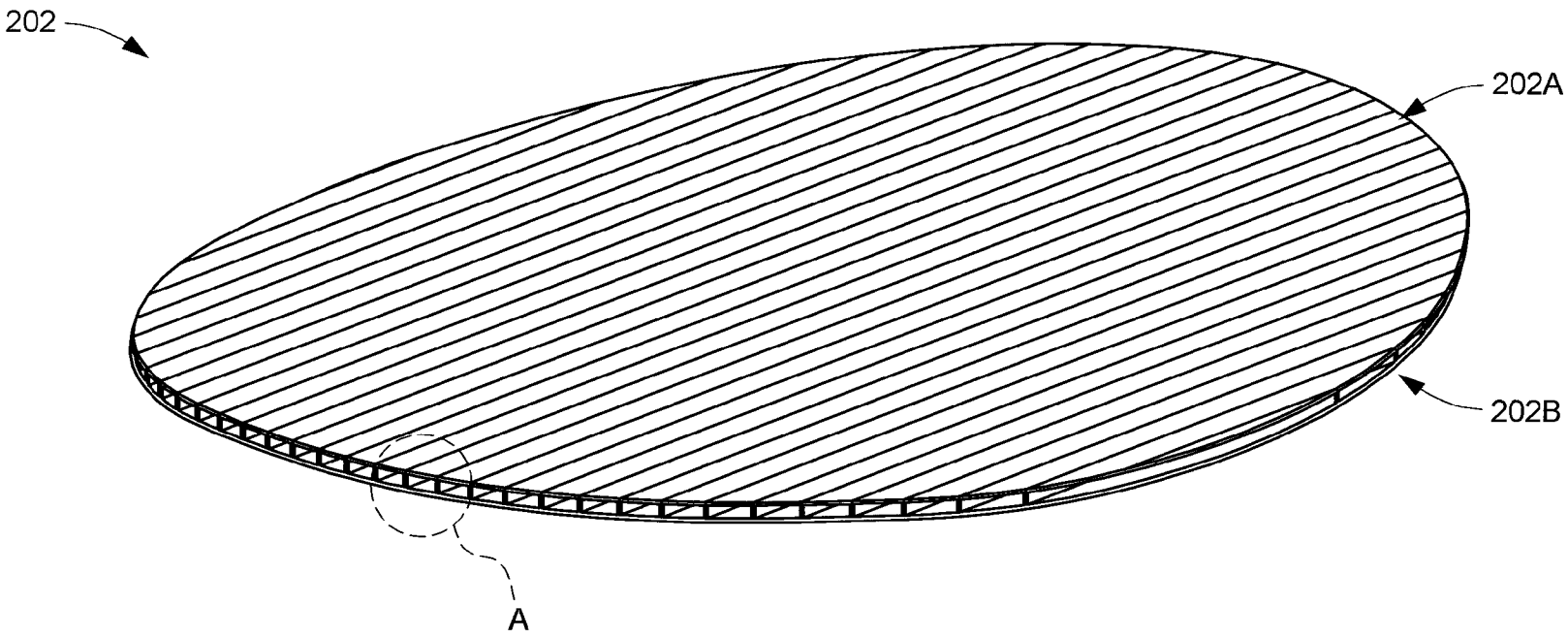
FIG. 6 is a schematic view illustrating the construction of a support board that can be assembled in the resting support.
Figure 7:
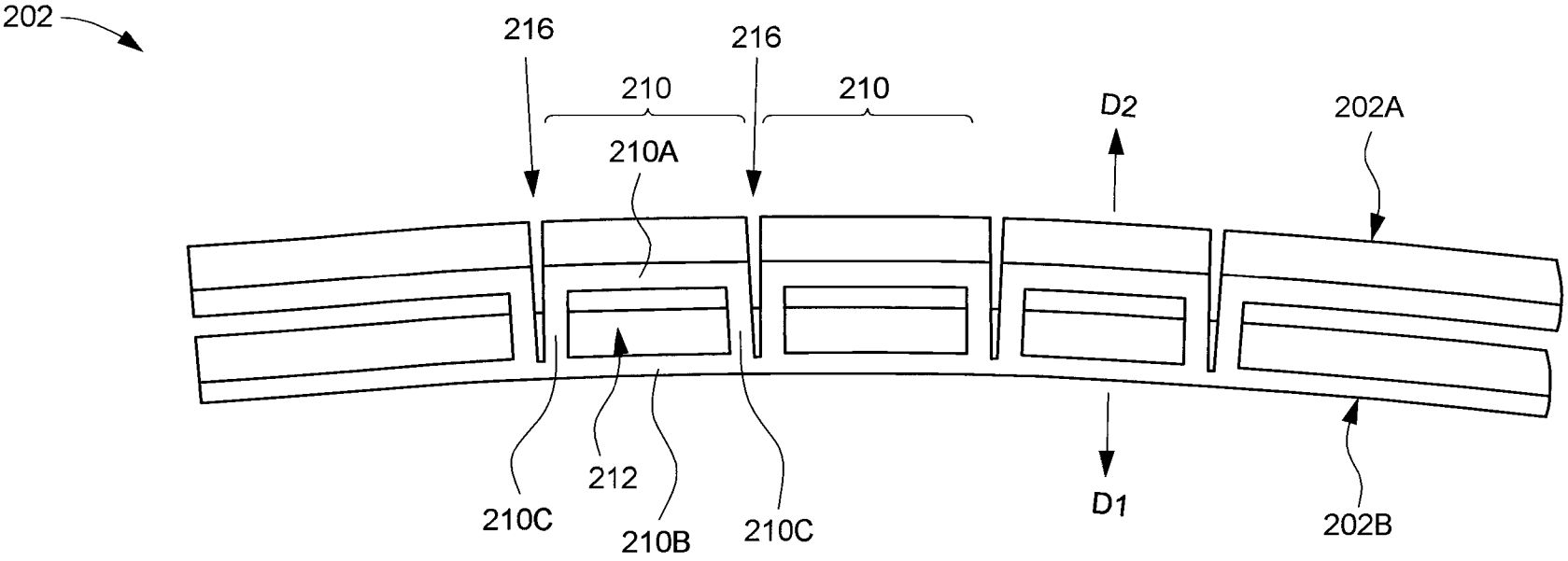
FIG. 7 is a partially enlarged view illustrating portion A of FIG. 6.

FIG. 6 is a schematic view illustrating one embodiment of a support board 202 that can be assembled in the bearing platform 134 and provide the aforementioned deformation capabilities, and FIG. 7 is a partially enlarged view illustrating portion A of FIG. 6. The support board 202 can be integrally formed in a single piece from a plastics material. The support board 202 can have a first side 202A and an opposite second side 202B, and include an array of hollow cells 210 that are joined together. Each cell 210 can include a plurality of sidewalls 210A, 210B and 210C that delimit an inner cavity 212 of the cell 210. Adjacent cells 210 can have their respective sidewalls 210B connected each other on the second side 202B, such that that the cells 210 can be joined together at the second side 202B of the support board 202. On the other hand, the first side 202A of the support board 202 can include a plurality of slits 216 that are respectively delimited between the sidewalls 210C of each pair of adjacent cells 210, and separate from one another the sidewalls 210A of the cells 210 on the first side 202A of the support board 202. The slits 216 can partly disconnect the cells 210 from one another so as to allow relative deflecting movements between the cells 210. When the support board 202 is assembled with the cushion element 140, the first side 202A can lie adjacent to the first layer 144 (i.e., corresponding to the first region R1), and the second side 202B adjacent to the second layer 146 (i.e., corresponding to the second region R2).

Referring to FIGS. 3 through 6, when the child is supported on the second region R2, the weight of the child is applied from the second side 202B of the support board 202. This pressure can cause the cells 210 to pivot about their respective joining portions. As a result, the cells 210 can deflect relative to one another in a way that enlarges the slits 216 and splits the sidewalls 210C of adjacent cells 210 away from each other. Accordingly, the support board 202 can freely bend in a first direction D1, which causes the bearing surface BS2 to sink and suitably conform to the child's body for providing a comfortable resting position. Aside bending movements, the inner cavities 212 can also permit the cells 210 to deform to provide comfortable support of the child.

On the other hand, when the child is supported on the first region R1, the weight is applied from the first side 202A of the support board 202. This pressure can cause the sidewalls 210C of adjacent cells 210 to contact against each other, which can substantially prevent bending of the support board 202 in a second direction D2 opposite to the first direction D1. As a result, the first bearing surface BS1 can provide a flat and stable support for better accessibility while changing the child's diaper.

The support board 202 can therefore deform differently depending on whether the load of the child's weight is exerted from the first side 202A or the second side 202B of the support board 202, which can result in different firmness of the first and second bearing surfaces BS1 and BS2. The firmness of the first and second bearing surfaces BS1 and BS2 can be assessed by determining how each of the first and second bearing surfaces BS1 and BS2 bends and the depth to which it sinks upon application of a load pressure, i.e., the bend curvature and sinking depth of the support board 202 can be different depending on whether the child's weight is applied from the first side 202A or second side 202B For example, the second bearing surface BS2 can bend and sink to a greater depth when the child is placed thereon, whereas the first bearing surface BS1 can hardly sink when the child is placed thereon. Accordingly, the bearing platform 134 can provide adequate support curvatures respectively in accordance with the required use conditions, e.g., the changing table requires a flat surface for easy accessibility, and the sleeping bed requires a bent curvature for increased comfort.

Figure 8:
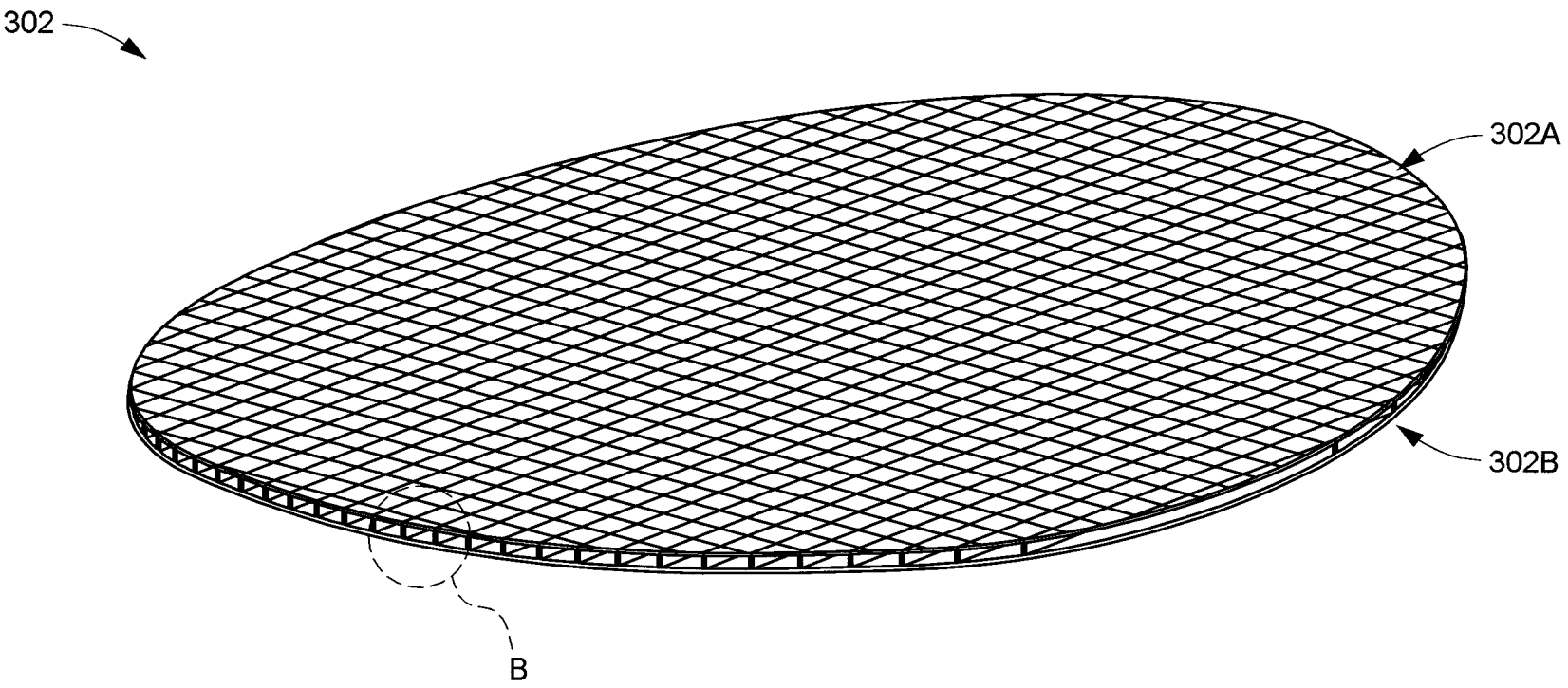
FIG. 8 is a schematic view illustrating another embodiment of a support board that can be assembled in the resting support.
Figure 9:
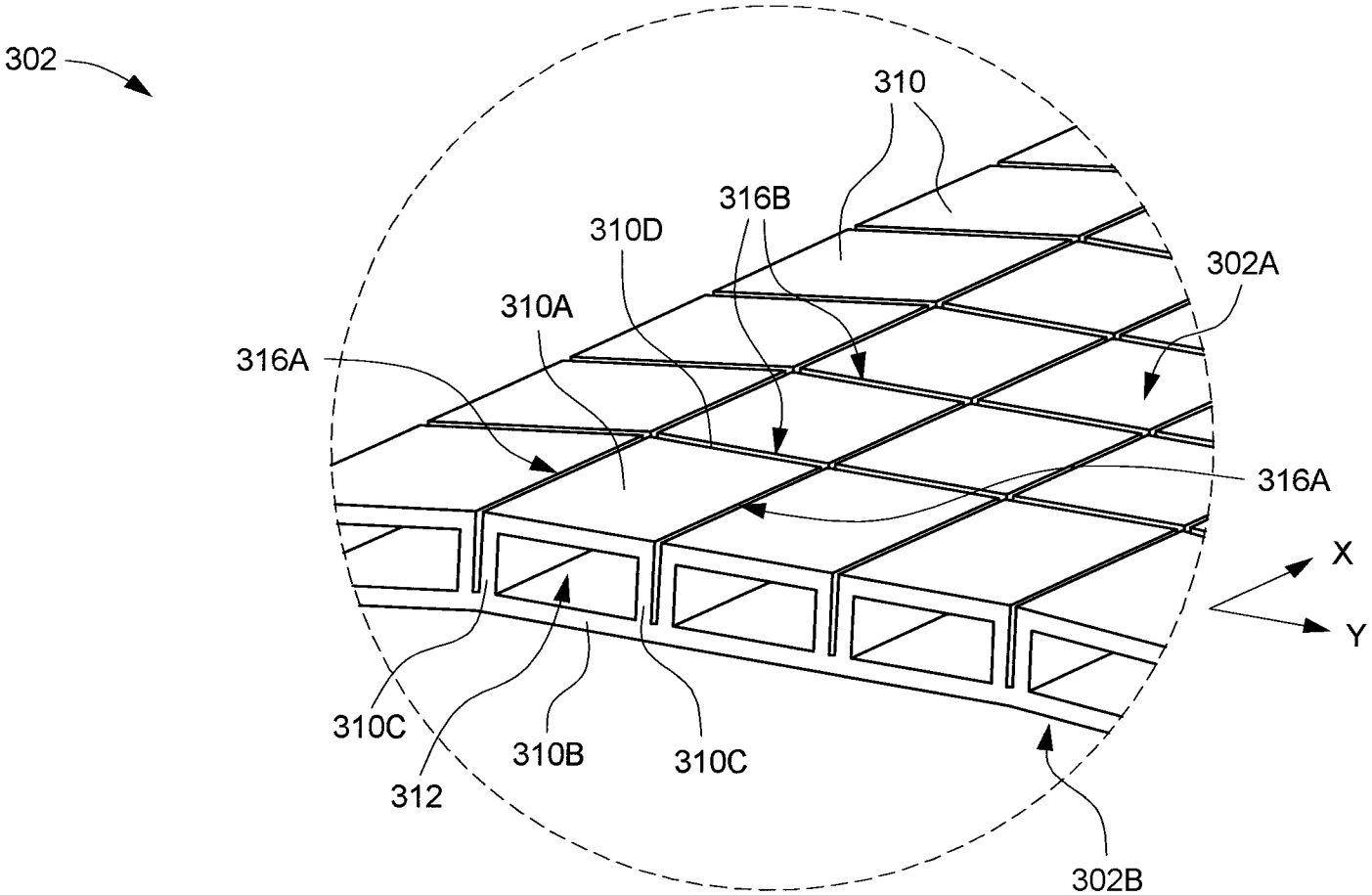
FIG. 9 is a partially enlarged view illustrating portion B of FIG. 8.

FIG. 8 is a schematic view illustrating another support board 302 suitable for use with the bearing platform 134 described previously, and FIG. 9 is an enlarged view of portion B shown in FIG. 8. The support board 302 can be similar to the support board 202 in construction, having a first side 302A and an opposite second side 302B, and including an array of hollow cells 310 that are joined together. Each cell 310 can include a plurality of sidewalls 310A, 310B, 310C and 310D that delimit an inner cavity 312 of the cell 310. Adjacent cells 310 can have their respective sidewalls 310B connected each other on the second side 302B, such that the cells 310 can be joined together at the second side 302B of the support board 302. On the other hand, the first side 302A of the support board 302 can include a plurality of slits 316A and 316B that respectively extend parallel to two intersecting directions X and Y. The slits 316A can be delimited between the sidewalls 310C of two adjacent cells 310, and the slits 316B can be delimited between the sidewalls 310D of two adjacent cells 310. As a result, the sidewalls 310A of the cells 310 can be separated from one another, and the slits 316A and 316B can partly disconnect the cells 310 so as to allow relative deflecting movements between the cells 210.

When the support board 302 is assembled with the cushion element 140, the first side 302A can lie adjacent to the first layer 144 (i.e., corresponding to the first region R1), and the second side 302B adjacent to the second layer 146 (i.e., corresponding to the second region R2). Like previously described, when the child is supported on the second region R2, the weight of the child is applied from the second side 302B of the support board 302. This pressure can cause the cells 310 to pivot about their respective joining portions. Because the joining portions of the cells 310 extend along two directions X and Y, the support board 302 can bend in different planes of curvature. As a result, the capacity of the support board 302 to deform is increased to better fit the shape of the child's body. When the child is supported on the first region R1, the weight is applied from the first side 302A of the support board 302. This pressure can cause the sidewalls 310C and 310D of adjacent cells 310 to contact against each other, which can substantially prevent bending of the support board 302 in the second direction D2.

Figure 10:
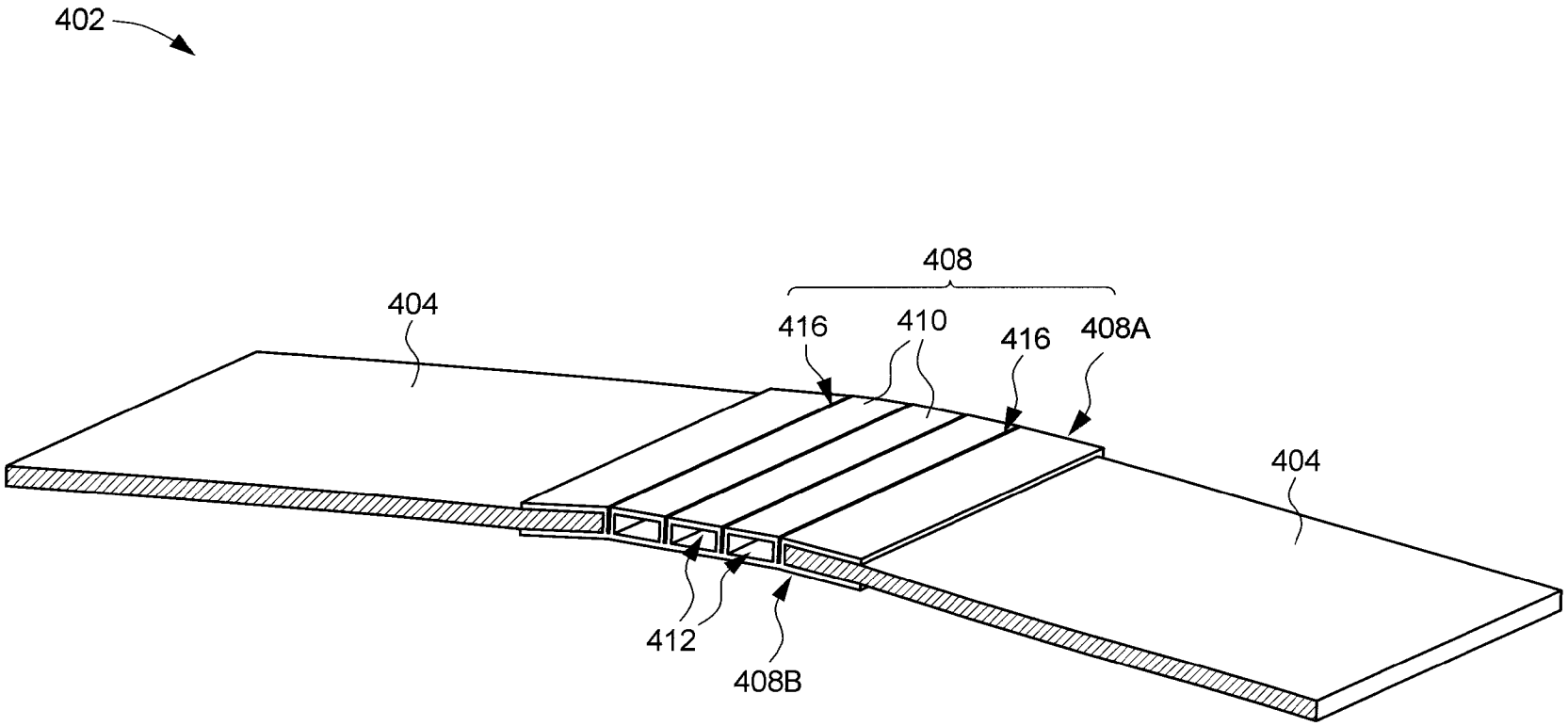
FIG. 10 is a schematic view illustrating yet another embodiment of a support board that can be assembled in the resting support of the child holding accessory.

FIG. 10 is a schematic view illustrating the construction of another support board 402. The support board 402 can include two board elements 404, and a resilient joint element 408. The board elements 404 can be made from any rigid materials, such as plastics, woods and the like. The joint element 408 can elastically deform to allow relative displacement between the board elements 404. In one embodiment, the joint element 408 can have a flex structure similar to that of the support board 202 or 402, having opposite first and second sides 408A and 408B and including a plurality of hollow cells 410 provided with inner cavities 412. The cells 410 can be joined together on the second side 408B of the joint element 408, and disconnected on the first side 408A via a plurality of slits 414. The joint element 408 can thus freely deform when the load pressure is applied from the second side 408B. In contrast, bending deformation of the joint element 408 can be substantially prevented when the load pressure is applied from the first side 408A.

It is worth noting that the support board structures described herein may be advantageously used for any child holding devices in general. For example, seat modules in stroller, car seat, high chair and swing apparatuses may also use any of the support board structures illustrated above to provide increased comfort.

At least one advantage of the structures described herein is the ability to provide a child holding accessory that can integrate two opposite regions adapted to receive a child in different configurations of use. In particular, the child holding accessory can include a support board that can deform differently depending on the region where the child is placed. As a result, the bearing surfaces associated with the two regions can present different firmness to provide adequate resting of the child.

Realizations in accordance with the present invention therefore have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. A child holding accessory suitable for use with a play yard, comprising:

a reversible resting support having opposite first and second regions respectively, each being positionable to be upwardly facing to receive a child, wherein the first region has a first bearing surface and the second region has a second bearing surface, the first and second bearing surfaces facing opposite directions, and the first and second bearing surfaces bending to different depths when the child is respectively placed thereon; and at least one fixture usable to attach the resting support with a play yard.

2. The child holding accessory according to claim 1, wherein the resting support includes a surrounding frame, and a bearing platform assembled with the surrounding frame and defining the first and second regions.

3. The child holding accessory according to claim 2, wherein the surrounding frame has a curved side frame segment.

4. The child holding accessory according to claim 3, wherein the side frame segment has a curved shape that projects upward when the first region is turned upward, and projects downward when the second region is turned upward.

5. The child holding accessory according to claim 2, wherein the bearing platform comprises a cushion element including a first layer at the first region, and a second layer at the second region.

6. The child holding accessory according to claim 5, wherein the first layer includes one of a polyvinyl chloride (PVC)-based fabric, ethylene vinyl acetate (EVA)-based polymer fabric, and any water-proof and easy to wipe-off fabrics.

7. The child holding accessory according to claim 5, wherein the second layer includes one of a cotton cloth, flannelette, and any soft and comfortable fabric.

8. The child holding accessory according to claim 5, wherein one of the first and second layer includes a raised portion able to receive a child's head.

9. The child holding accessory according to claim 2, wherein the resting support is attachable to a play yard via a first fixture and a second fixture, the surrounding frame has a head-side frame segment and a foot-side frame segment that are respectively mounted with the first and second fixture, one of the first and second fixture has a pivot point that defines a rotation axis of the surrounding frame, a first distance between the head-side frame segment and the rotation axis being smaller than a second distance between the foot-side frame segment and the rotation axis.

10. The child holding accessory according to claim 1, wherein the resting support includes a support board having a first side associated with the first region, and a second side associated with the second region, the support board being deformable differently depending on whether the child is placed on the first or second region.

11. The child holding accessory according to claim 10, wherein the first region is configured as a changing table and the second region is configured as a sleeping bed, and the support board is configured to bend to a greater extent when the child is placed on the second region than when the child is placed on the first region.

12. The child holding accessory according to claim 10, wherein the support board includes an array of cells connected with one another.

13. The child holding accessory according to claim 12, wherein the first side of the support board includes a plurality of slits located between the cells and the cells are connected at the second side to allow relative deflection between the cells.

14. The child holding accessory according to claim 13, wherein all of the slits extend substantially parallel to a same direction.

15. The child holding accessory according to claim 13, wherein the slits include a plurality of first slits that extend substantially parallel to a first direction, and a plurality of second slits that extend substantially parallel to a second direction intersecting the first direction.

16. The child holding accessory according to claim 12, wherein the support board including the cells is integrally formed in a single piece.

17. The child holding accessory according to claim 12, wherein each of the cells includes an inner cavity.

18. The child holding accessory according to claim 10, wherein the support board includes two board elements, and an elastic joint element connecting the board elements together.

19. The child holding accessory according to claim 18, wherein the joint element includes an array of cells, and a plurality of slits partly disconnecting the cells and the cells are connected at the second side to allow relative deflection between the cells.

20. A play yard comprising:

a support frame; and the child holding accessory according to claim 1, assembled with the support frame.

* * * * *